US005802748A

United States Patent [19]

Haagenstad

[11] Patent Number: 5,802,748

[45] Date of Patent: Sep. 8, 1998

[54] TIERED TRENCHING BACKHOE SYSTEM

[76] Inventor: Ronald G. Haagenstad, 119 Summer Heaven Dr., Blackhawk, Colo. 80403-9032

[21] Appl. No.: 679,851

[22] Filed: Jul. 15, 1996

[51] Int. Cl.[6] ..... E02F 3/96

[52] U.S. Cl. ..... 37/405; 37/403; 37/903; 414/724

[58] Field of Search ..... 37/403, 404, 405, 37/407, 903; 172/699; 414/724

[56] References Cited

U.S. PATENT DOCUMENTS

| | | | |
|---|---|---|---|
| 2,838,856 | 6/1958 | Buisse | 37/404 |
| 2,864,184 | 12/1958 | Fohr | 37/404 |
| 2,896,343 | 7/1959 | Raby | 37/407 |
| 3,181,256 | 5/1965 | Discenza | 37/404 |
| 3,307,277 | 3/1967 | Kondracki | 414/724 X |
| 3,478,449 | 11/1969 | Baker | 37/403 |
| 3,942,271 | 3/1976 | George | 37/404 |
| 4,009,529 | 3/1977 | Johnson | 37/404 |
| 4,038,766 | 8/1977 | Felstet | 37/403 X |
| 4,085,530 | 4/1978 | Laundry | 37/403 X |
| 4,360,980 | 11/1982 | Jarvis | 37/404 |
| 4,550,512 | 11/1985 | Felstet | 37/403 |
| 4,704,811 | 11/1987 | Jefferson | 37/364 |
| 5,212,897 | 5/1993 | Jefferson | 37/403 |

*Primary Examiner*—Terry Lee Melius
*Assistant Examiner*—Thomas A. Beach

[57] ABSTRACT

A new Tiered Trenching Backhoe System for creating a dual tiered trench which allows one service utility to be elevated above another service utility thereby preventing contact of the two service utilities resulting in increased safety. The inventive device includes a syncline plate with an interior angle of approximately 140 degrees, a first and second triangular coupler welded at one end to the syncline plate removably coupling to a pair of existing tooth shanks of a backhoe bucket, a first and second fluke welded to the syncline plate opposite of the triangular couplers, a first and second trihedral support members welded to the interior portion of syncline plate providing support, and a pair of replaceable teeth removably secured to the first and second flukes.

6 Claims, 3 Drawing Sheets

10
12
20
20
70
70

3
3
10
12
14
50
20
70

FIG 3
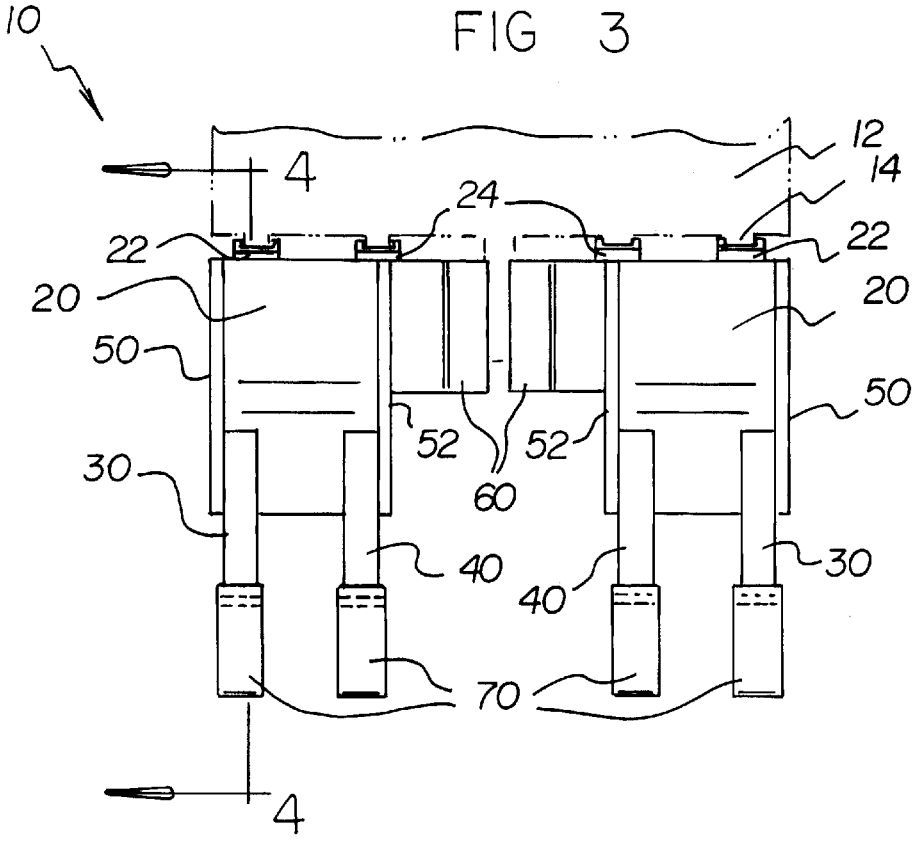
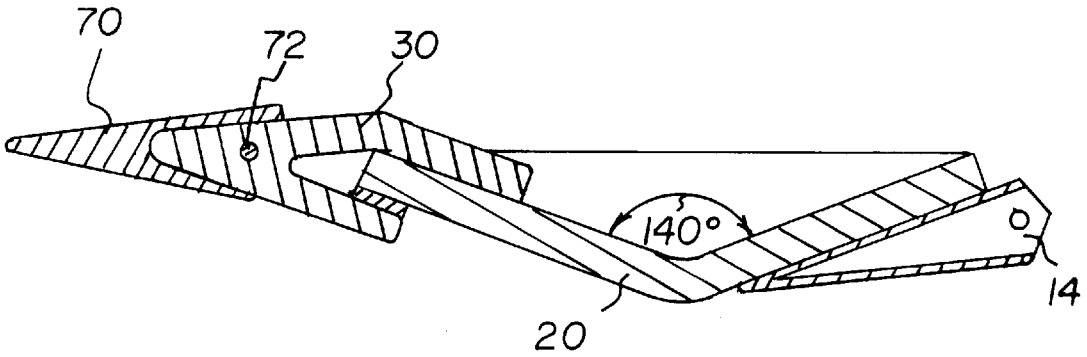
FIG 4

TIERED TRENCHING BACKHOE SYSTEM

BACKGROUND OF THE INVENTION

1. Field of the Invention

The present invention relates to Trenching Devices and more particularly pertains to a new Tiered Trenching Backhoe System for creating a dual tiered trench which allows one service utility to be elevated above another service utility thereby preventing contact of the two service utilities resulting in increased safety.

2. Description of the Prior Art

The use of Trenching Devices is known in the prior art. More specifically, Trenching Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Trenching Devices include U.S. Pat. No. 5,212,897; U.S. Pat. No. 4,704,811; U.S. Pat. No. 5,197,212; U.S. Pat. No. 4,718,182; U.S. Pat. No. 4,360,980 and U.S. Design Pat. No. 264,213.

While these devices fulfill their respective, particular objectives and requirements, the aforementioned patents do not disclose a new Tiered Trenching Backhoe System. The inventive device includes a syncline plate with an interior angle of approximately 140 degrees, a first and second triangular coupler welded at one end to the syncline plate removably coupling to a pair of existing tooth shanks of a backhoe bucket, a first and second fluke welded to the syncline plate opposite of the triangular couplers, a first and second trihedral support members welded to the interior portion of syncline plate providing support, and a pair of replaceable teeth removably secured to the first and second flukes.

In these respects, the Tiered Trenching Backhoe System according to the present invention substantially departs from the conventional concepts and designs of the prior art, and in so doing provides an apparatus primarily developed for the purpose of creating a dual tiered trench which allows one service utility to be elevated above another service utility thereby preventing contact of the two service utilities resulting in increased safety.

SUMMARY OF THE INVENTION

In view of the foregoing disadvantages inherent in the known types of Trenching Devices now present in the prior art, the present invention provides a new Tiered Trenching Backhoe System construction wherein the same can be utilized for creating a dual tiered trench which allows one service utility to be elevated above another service utility thereby preventing contact of the two service utilities resulting in increased safety.

The general purpose of the present invention, which will be described subsequently in greater detail, is to provide a new Tiered Trenching Backhoe System apparatus and method which has many of the advantages of the Trenching Devices mentioned heretofore and many novel features that result in a new Tiered Trenching Backhoe System which is not anticipated, rendered obvious, suggested, or even implied by any of the prior art Trenching Devices, either alone or in any combination thereof.

To attain this, the present invention generally comprises a syncline plate with an interior angle of approximately 140 degrees, a first and second triangular coupler welded at one end to the syncline plate removably coupling to a pair of existing tooth shanks of a backhoe bucket, a first and second fluke welded to the syncline plate opposite of the triangular couplers, a first and second trihedral support members welded to the interior portion of syncline plate providing support, and a pair of replaceable teeth removably secured to the first and second flukes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of application, which is measured by the claims, nor is it intended to be limiting as to the scope of the invention in any way.

It is therefore an object of the present invention to provide a new Tiered Trenching Backhoe System apparatus and method which has many of the advantages of the Trenching Devices mentioned heretofore and many novel features that result in a new Tiered Trenching Backhoe System which is not anticipated, rendered obvious, suggested, or even implied by any of the prior art Trenching Devices, either alone or in any combination thereof.

It is another object of the present invention to provide a new Tiered Trenching Backhoe System which may be easily and efficiently manufactured and marketed.

It is a further object of the present invention to provide a new Tiered Trenching Backhoe System which is of a durable and reliable construction.

An even further object of the present invention is to provide a new Tiered Trenching Backhoe System which is susceptible of a low cost of manufacture with regard to both materials and labor, and which accordingly is then susceptible of low prices of sale to the consuming public, thereby making such Tiered Trenching Backhoe System economically available to the buying public.

Still yet another object of the present invention is to provide a new Tiered Trenching Backhoe System which provides in the apparatuses and methods of the prior art some of the advantages thereof, while simultaneously overcoming some of the disadvantages normally associated therewith.

Still another object of the present invention is to provide a new Tiered Trenching Backhoe System for creating a dual tiered trench which allows one service utility to be elevated above another service utility thereby preventing contact of the two service utilities resulting in increased safety.

Yet another object of the present invention is to provide a new Tiered Trenching Backhoe System which includes a syncline plate with an interior angle of approximately 140 degrees, a first and second triangular coupler welded at one end to the syncline plate removably coupling to a pair of existing tooth shanks of a backhoe bucket, a first and second fluke welded to the syncline plate opposite of the triangular couplers, a first and second trihedral support members welded to the interior portion of syncline plate providing support, and a pair of replaceable teeth removably secured to the first and second flukes.

Still yet another object of the present invention is to provide a new Tiered Trenching Backhoe System that can be utilized to step trench.

Even still another object of the present invention is to provide a new Tiered Trenching Backhoe System that is easy to install and remove from a backhoe bucket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a magnified rear view of the present invention.

FIG. 4 is a cross sectional view taken along line 4—4 of FIG. 3.

DESCRIPTION OF THE PREFERRED EMBODIMENT

Figure 1:
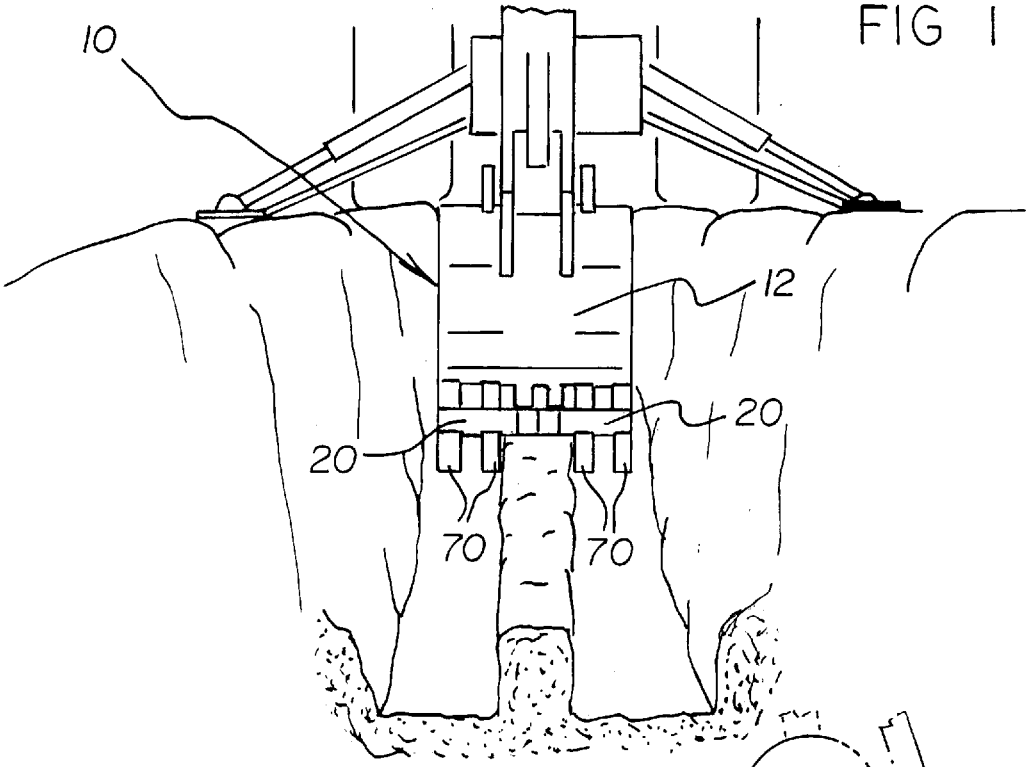
FIG. 1 is a rear view of a new Tiered Trenching Backhoe System according to the present invention.
Figure 2:
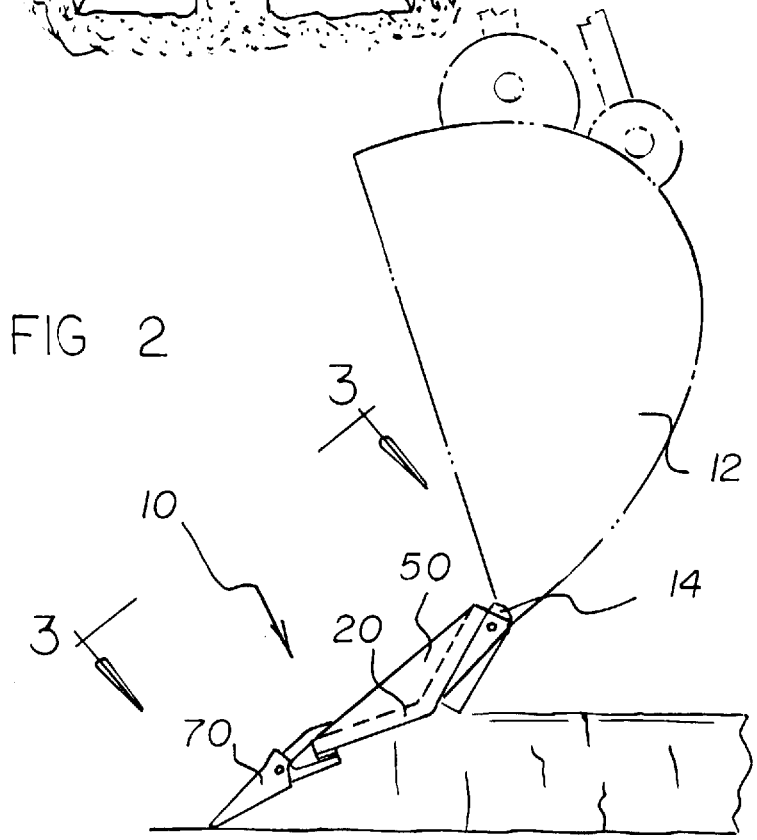
FIG. 2 is a side view thereof.

With reference now to the drawings, and in particular to FIGS. 1 through 5 thereof, a new Tiered Trenching Backhoe System embodying the principles and concepts of the present invention and generally designated by the reference numeral 10 will be described.

More specifically, it will be noted that the Tiered Trenching Backhoe System 10 comprises a syncline plate 20, a first fluke 30 secured at one end of the syncline plate 20 projecting orthogonal to the central bend within the syncline plate 20, a second fluke 40 secured at the end securing the first fluke 30 and projecting parallel to the first fluke 30, a first trihedral support member 50 secured to an elongated edge of the syncline plate 20 projecting orthogonal to the cornice of the syncline plate 20, a second trihedral support member 52 secured to the elongated edge of the syncline plate 20 opposite of the first trihedral support member 50 projecting parallel to said first trihedral support member 50, and a planar side member 60 secured to the side of the syncline plate 20 securing the second trihedral support member 52 and opposite of the first and second flukes 30, 40 projecting parallel to the syncline plate 20, where said planar side member 60 near the center includes a downward bend.

Figure 5:
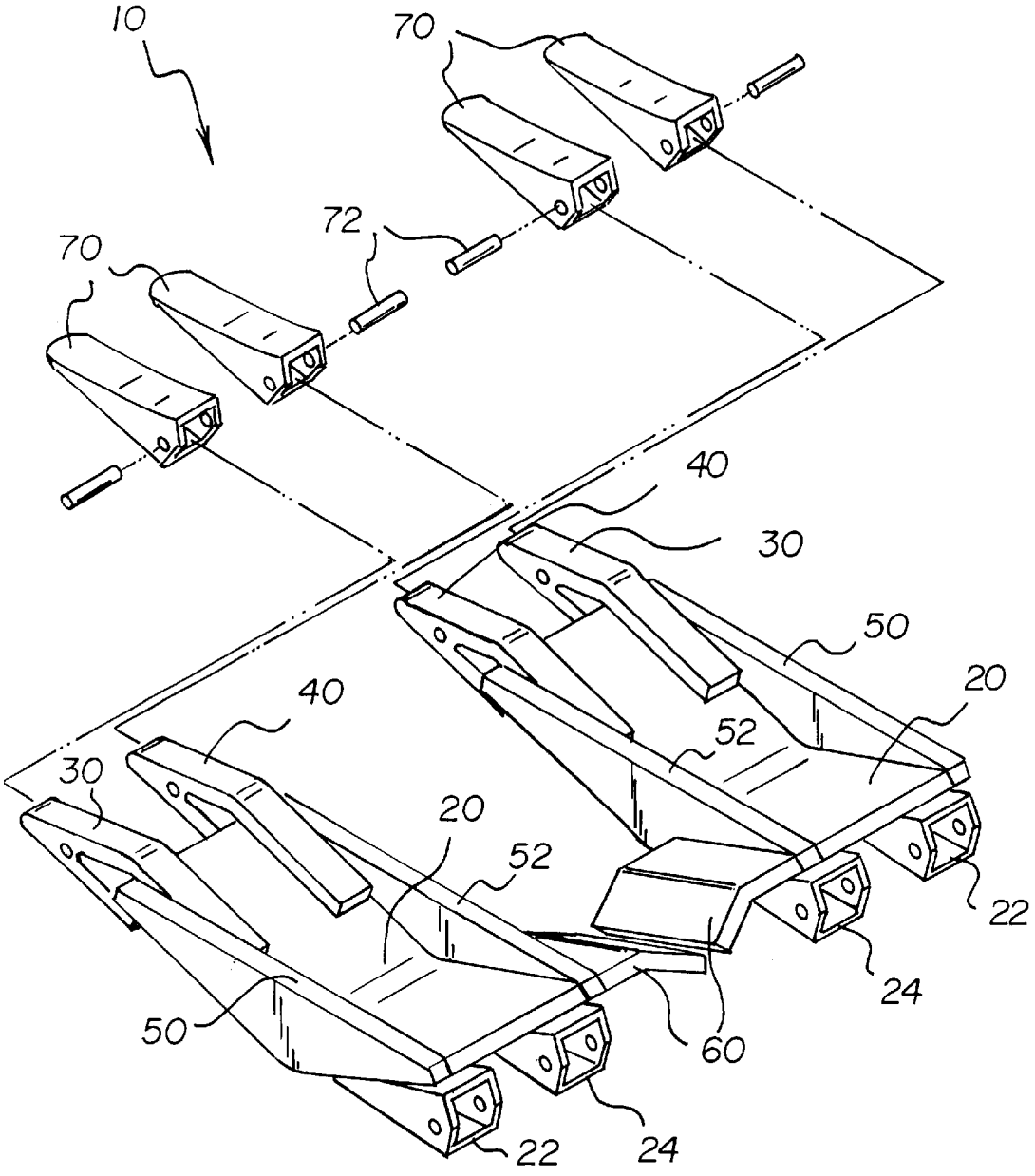
FIG. 5 is an exploded isometric view of the present invention.

As best illustrated in FIGS. 1 through 5, it can be shown that the syncline plate 20 includes a first triangular coupler 22 secured to the end opposite of the first and second flukes 30, 40, and projecting parallel to said flukes 30, 40. A second triangular coupler 24 is secured to the end securing the first triangular coupler 22, and projecting parallel to the first triangular coupler 22. Said first and second triangular couplers 22, 24 removably attach to a pair of existing tooth shanks 14 secured to a backhoe bucket 12 thereby removably attaching the present invention. A pair of replaceable teeth 70 removably attach to the first and second flukes 30, 40 by a pair of teeth coupling pins 72 projecting through as best shown in FIG. 5 of the drawings. The syncline plate 20 preferably has an interior angle of approximately 140 degrees. All of the components are preferably welded together by continuous welds. The first and second triangular couplers 22, 24 either connect to the two rightmost existing tooth shanks 14, the two centermost existing tooth shanks 14, or the two leftmost existing tooth shanks 14 leaving a tier within the trench as shown in FIG. 1 of the drawings. The present invention also includes another mirrored invention which can be secured opposite of the first invention as disclosed in FIG. 1 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Tiered Trenching Backhoe System comprising:

a trenching plate having a transverse bend therein located between substantially planar first and second plate portions of said trenching plate, said trenching plate having first and second end edges oriented substantially parallel to said transverse bend and having lateral side edges extending between said end edges;

a first tooth mount secured to said first end edge of the trenching plate and projecting in a direction substantially orthogonal to said first end edge;

a second tooth mount secured to said first end edge and projecting from said first end edge in an orientation substantially parallel to the first tooth mount;

a first support member secured to one of the lateral edges of the trenching plate, said support member projecting in a direction substantially orthogonal to the second end edge of the trenching plate;

a second support member secured to the opposed lateral edge of the trenching plate, said support member projecting in a direction substantially parallel to said first support member; and a planar side member secured to the lateral side edge of the trenching plate adjacent to the second support member and projecting substantially parallel to a plate portion of said trenching plate, wherein said planar side member includes a downward bend therein at a location spaced from said lateral side edge.

2. The Tiered Trenching Backhoe System of claim 1, wherein the trenching plate includes:

a first triangular coupler secured to the second end edge of said trenching plate and projecting substantially parallel to said tooth mounts;

a second triangular coupler secured to the second end edge of said trenching plate and projecting substantially parallel to the first triangular coupler;

said first and second triangular couplers being removably attachable to a pair of existing tooth shanks secured to a backhoe bucket.

3. The Tiered Trenching Backhoe System of claim 1 additionally comprising a pair of replaceable teeth, each said replaceable tooth being removably attachable to a tooth mount by a pair of teeth tooth coupling pin.

4. The Tiered Trenching Backhoe System of claim 1 wherein the plate portions of said trenching plate define an interior angle therebetween of approximately 140 degrees.

5. A The Tiered Trenching Backhoe System of claim 2 wherein the first and second triangular couplers are adapted to connect to the two rightmost existing tooth shanks, the two centermost existing tooth shanks, or the two leftmost existing tooth shanks of a backhoe bucket for forming at least two tiers within a trench dug by said backhoe bucket.

6. The Tiered Trenching Backhoe System of claim 1 additionally comprising a second trenching plate having a transverse bend therein located between substantially planar first and second plate portions of said trenching plate, said trenching plate having first and second end edges oriented substantially parallel to said transverse bend and having lateral side edges extending between said end edges;

a first tooth mount secured to said first end edge of the trenching plate and projecting in a direction substantially orthogonal to said first end edge;

a second tooth mount secured to said first end edge and projecting from said first end edge in an orientation substantially parallel to the first tooth mount;

a first support member secured to one of the lateral edges of the trenching plate, said support member projecting in a direction substantially orthogonal to the second end edge of the trenching plate;

a second support member secured to the opposed lateral edge of the trenching plate, said support member projecting in a direction substantially parallel to said first support member; and a planar side member secured to the lateral side edge of the trenching plate adjacent to the second support member and projecting substantially parallel to a plate portion of said trenching plate.

* * * * *